US006873805B2

(12) United States Patent
Stelter et al.

(10) Patent No.: US 6,873,805 B2
(45) Date of Patent: Mar. 29, 2005

(54) TONER REPLENISHMENT BASED ON WRITER CURRENT

(75) Inventors: Eric C. Stelter, Pittsford, NY (US); Kenneth P. Friedrich, Honeoye, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 58 days.

(21) Appl. No.: 10/177,736

(22) Filed: Jun. 21, 2002

(65) Prior Publication Data

US 2003/0016956 A1 Jan. 23, 2003

Related U.S. Application Data

(60) Provisional application No. 60/302,209, filed on Jun. 29, 2001.

(51) Int. Cl.[7] ..... G03G 15/00; G03G 15/08

(52) U.S. Cl. ..... 399/58; 399/48; 399/49

(58) Field of Search ..... 399/53, 58–60, 399/47–49, 51, 27; 347/140

(56) References Cited

U.S. PATENT DOCUMENTS 5,546,165 A * 8/1996 Rushing et al. ..... 399/51
5,987,271 A * 11/1999 Regelsberger et al. ..... 399/49
6,167,210 A * 12/2000 Maess et al. ..... 399/51
6,477,338 B2 * 11/2002 Hisano et al. ..... 399/49
2002/0044784 A1 * 4/2002 Kato ..... 399/27

FOREIGN PATENT DOCUMENTS

JP 63008769 A * 1/1988 ..... G03G/15/08
JP 04216085 a * 8/1992 ..... B41J/27/04
JP 05232815 A * 9/1993 ..... G03G/15/08

* cited by examiner

*Primary Examiner*—Susan Lee
(74) *Attorney, Agent, or Firm*—Richard A. Romanchik

(57) ABSTRACT

A method and apparatus for replenishing toner based on the electric current used over time by the exposure subsystem. Toner take-out for each image is estimated by measuring the current used by the exposure system, subtracting the quiescent current, integrating over a page or frame, and multiplying by a predetermined value that indicates the amount of toner required by the image, based on the average current used for the exposure and other process parameters. These calculations are done either in hardware or in software. The replenishment system is used to add the correct amount of toner to the developer station to maintain the toner concentration at an approximately constant aim value.

44 Claims, 2 Drawing Sheets

TONER REPLENISHMENT BASED ON WRITER CURRENT

CROSS-REFERENCE TO RELATED APPLICATIONS

This application claims the benefit of the priority date of Provisional Patent Application Ser. No. 60/302,209 filed Jun. 29, 2001.

FIELD OF INVENTION

This invention relates to electrographic recording apparatus such as that used in document copiers and printers, and more specifically to control of toner replenishment and monitoring of toner usage in an electrophotographic recording apparatus.

Definitions

The following terms well known in the art are defined here:

$I_{exp}$—Writer current used during exposure.

$V_{exp}$—Writer voltage used during exposure.

$E_0$—Light produced by the print head.

E—Actual exposure of photoconductor.

$V_0$—Primary voltage (relative to ground) on the photoconductor just after the charger.

This is sometimes referred to as the "initial" voltage.

$V_B$—Development station electrode bias.

The light $E_0$ produced by the print head illuminates the photoconductor and causes a particular level of exposure E of the photoconductor.

In general contrast and density control are achieved by the choice of the levels of $V_0$, $E_0$, and $V_B$ as is well known and described in the published literature.

DISCUSSION OF PRIOR ART

Two-component development systems for electrography or electrophotography use a toner and a magnetic carrier. Other ingredients are frequently included as flow aids or charge aids for these two principal components. During normal operation of a printing system, fresh toner is added periodically to the developer mixture to replace toner that leaves the toning system as images are developed. To indicate when more toner is required, a toner concentration monitor or process control patch is frequently used, as is well known in the art. From toner concentration, the amount of toner takeout can be determined.

There are direct and indirect methods of monitoring toner concentration in multicomponent systems. See U.S. Pat. No. 5,729,787 (Resch), incorporated herein by reference, for a short summary and further references. One measurement method indirectly measures toner concentration by measuring the toner laid down on the photoconductor. Direct methods use measurements made at the development stations. In one known approach, an infrared source is directed through a window in the development sump and the reflections back are measured and used to infer toner concentration. In another approach, a planar electric coil is disposed at a suitable position in the developer container surrounded by a stream of developer. The coil inductance increases as toner concentration decreases. In yet another approach, magnetic detectors are provided at a position in a container that holds the magnetic carrier and a color toner. A coupling coefficient of the magnetic circuit changes with concentration of the toner. Still another approach sends electromagnetic energy along a probe and into the development (toner/carrier) mixture. The difference in impedance between the mixture and the probe is a measure of concentration and is used to initiate adjustment of the composition content of the development mixture.

For toner replenishment system calibration, see U.S. Pat. No. 5,649,266 (Rushing) incorporated herein by reference. For closed loop control of toner concentration for use in controlling replenishment of toner to the development station, see U.S. Pat. No. 5,678,131 (Alexandrovich, et al.), incorporated herein by reference. For a detailed explanation of the overall process control methods used in support of toner replenishment, see U.S. Pat. No. 6,121,986 (Regelsberger, et al.), incorporated herein by reference. For a detailed explanation of the toner replenishment process itself, see U.S. Pat. No. 6,181,886 (Hockey, et al.), incorporated herein by reference.

Reflectivity of image or test areas has been used to manage toner replenishment. U.S. Pat. No. 4,502,778 (Dodge, et al.) uses a sensor and a comparator for producing an output signal indicative of the reflectivity of the photoconductor using test patches on that photoconductor. U.S. Pat. No. 4,377,338 (Ernst) uses light reflectance of a maximum toned area and a minimum toned area, again using text patches on the photoconductor.

Grid and development bias voltages have also been used. U.S. Pat. No. 5,262,825 (Nordeen, et al.) shows an image density process control system for a full color electrophotographic proofing system. The system uses grid and development bias voltages combined with density measurements to create a model set of parameter values for image density control, but does not use exposure current or power. The method is defined for laser printers and copiers.

Further methods use pixel count and pixel type to manage toner replenishment. U.S. Pat. No. 5,724,627 (Okuno, et al.) uses a correction coefficient determined on the basis of the pixel frequency at each density level of a document read by image scanning, combined with tone curves and tone expression patterns (set by the emission duty ratio and emission cycle of the laser which exposes the photosensitive member) selected by an operator. The method is defined for laser printers and copiers. U.S. Pat. No. 4,847,659 (Resch) uses a toner depletion signal proportional to the number of character print signals applied to a print head, the characters preferably being pixels to be toned.

For digital printers, pixel counting provides an advance estimate of toner use before any change is observed in the image density or toner concentration. However, it has the offsetting disadvantage of requiring special electronics to be added to a standard raster image processor. Additionally, for gray-scale printing the density of each pixel also needs to be taken into account, which complicates the use of the pixel count, a second disadvantage.

Other approaches use test or reference image toner density measurements, and many further methods use direct toner density/concentration measurement, to manage toner replenishment. Each of the families of methods outlined above has its own associated cost and complexity.

SUMMARY

The invention is a system and process for measuring toner consumption and replenishing consumed toner in an electrographic printing system. In electrophotographic engines, the invention uses a photoconductor traveling along a path for receiving and developing a latent image. The path passes a plurality of processing stations including a charging station for charging the photoconductor to a desired charge level, an exposure station for exposing the photoconductor to a document to selectively discharge the photoconductor and form a latent image of the document, a toning station for applying toner to the photoconductor to develop the latent image, and a transfer station for transferring the developed latent image to a receiver sheet. At the exposure station, the invention mounts a current sensor. It calibrates the sensor by measuring quiescent current of the exposure device before exposure and storing that measurement. It uses the sensor throughout imaging by measuring the image exposure current of the exposure device. The invention compares the calibration current level with the averaged image current level using a differential amplifier and an integrator, and uses a logic and control unit for generating a toner replenishment signal proportional to the difference between the two averaged quantity signals. The invention may obtain its estimate of toner takeout by measuring currents, voltages, light intensities, power consumption, photoconductor toner densities, receiver sheet toner densities, or percent area coverage, any of which can be translated into a proportionate toner takeout measurement over time. The invention generates the replenishment signal by multiplying its measurements by a predetermined value that indicates the amount of toner required by each image. The invention then sends the replenishment signal to the toner replenishment subsystem.

Those skilled in the art understand that electrical power is the product of voltage and current. In conventional electrographic and electrophotographic machines, the voltage for the writer is usually held at a constant value and the current varies. As such, measuring only the current is sufficient to measure power. In a more general sense, one could measure both the applied voltage and the applied current, derive a product of the two over time, and then integrate the product over time to measure the total energy used to write an image. Power integrated over time is energy.

Other transducers can measure power in different ways. For example, a photocell in a densitometer measures power by converting the intensity of incident light into a current or a voltage. A portion of the incident light from the exposure system can be measured by a photodetector and is proportional to the power consumed in production of a latent image and ultimately the amount of toner used for that image. Light transmitted through a photoconductor, reflected from a photoconductor, or stray light from lenses can be used. Light reflected or transmitted from a toned photoreceptor or a copy sheet that carries the toned image can also be used to estimate the amount of toner required for replenishment of the toning system Another way of measuring power and energy is monitoring laser current and laser shutter current to generate signals representative of energy used to form an image in a laser print engine.

In its most general form, the invention consists of estimating toner takeout by monitoring the energy required to produce a latent image and replenishing the development system with a proportional amount of toner. The measurement of energy per image can be made during the process of creating the image or estimated afterwards from characteristics of the image such as average voltage of a latent image, area coverage of a toned image, or average density.

DETAILED DESCRIPTION OF INVENTION

Figure 1:
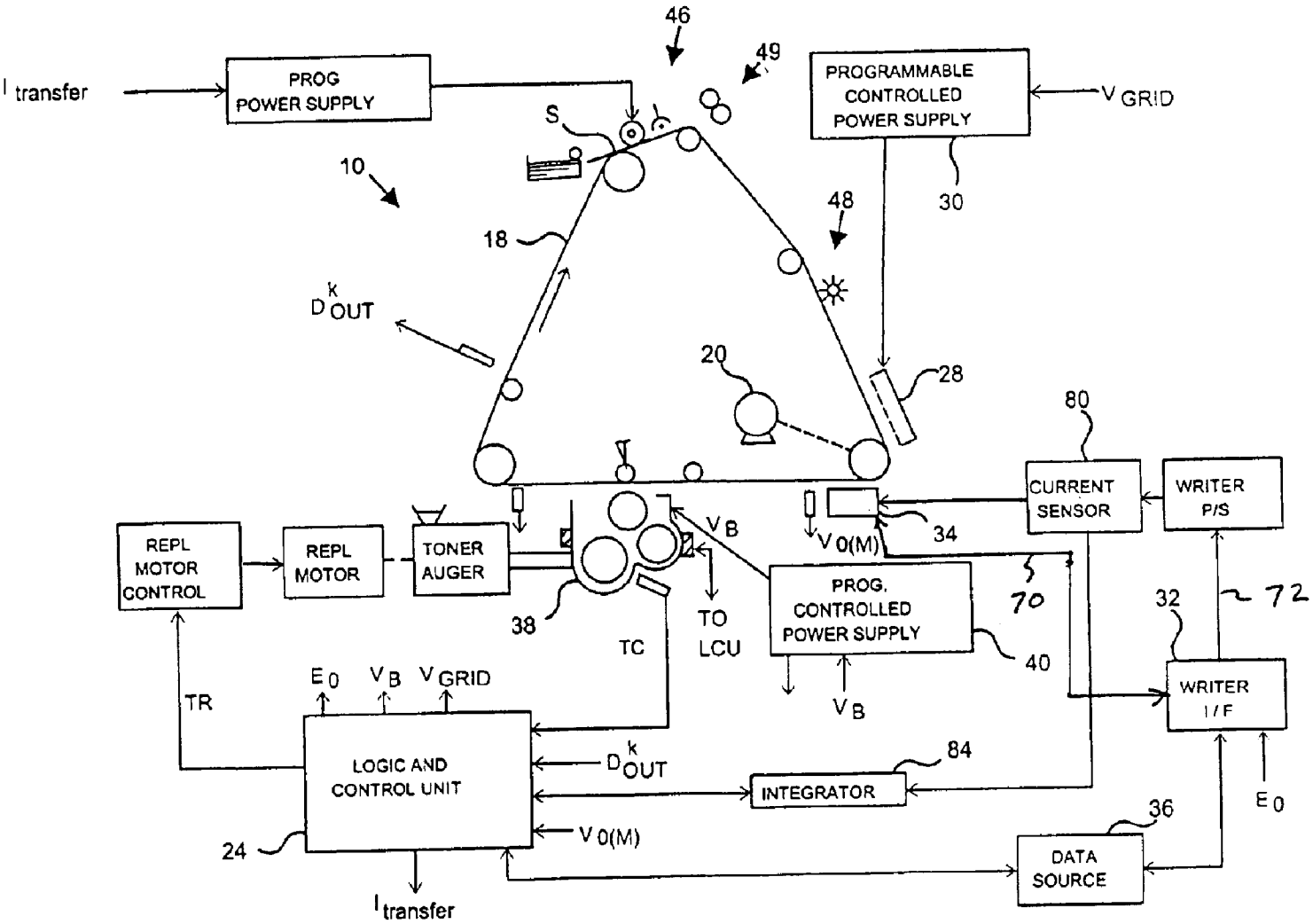
FIG. 1 shows the invention as installed in a typical electrophotographic printing system.

The machine 10 shown in FIG. 1, an electrophotographic printer, is typical of devices containing the invention. In machine 10, a moving recording member such as photoconductive belt 18 is driven by a motor 20 past a series of work stations of the printer. A logic and control unit (LCU) 24 has a digital computer that operates a stored program for sequentially actuating the workstations.

A charging station 28 sensitizes belt 18 by applying a uniform electrostatic charge of predetermined primary voltage $V_0$ to the surface of the belt 18. The output of the charger 28 is regulated by a programmable controller 30, which is in turn controlled by LCU 24 to adjust primary voltage $V_0$ in accordance with a grid control signal, $V_{grid}$ that controls movement of charges from charging wires to the surface of the recording member, as is well known.

At an exposure station 34, light projected from a write head dissipates the electrostatic charge on the photoconductive belt 18 to form a latent image of a document to be copied or printed. The write head preferably has an array of light-emitting diodes (LEDs) or some other light source such as lasers for exposing the photoconductive belt picture element (pixel) by picture element with an intensity regulated by a data source programmable controller 36 as determined by LCU 24. Alternatively, the exposure may be by optical projection of an image of a document onto the photoconductor. A still further alternative is creating electrostatic latent images on an electrographic recording medium using needle-like electrodes or other known means for forming such latent images.

Where an LED or other electro-optical exposure source is used, image data for recording is provided by a data source 36 such as a computer, a document scanner, a memory, a data network, etc. Signals from the data source 36 and/or LCU 24 may also provide control signals to a writer network, etc. Signals from the data source 36 and/or LCU 24 may also provide control signals to a writer interface 32 for identifying and selecting exposure correction parameters for use in controlling image density. The output of the writer interface 32 contains data on line 70 for the exposure station 34 and controls the writer power supply on line 72 that generates the current for the LEDs in the exposure station 34. In order to form calibration patches with density, the LCU 24 may be provided with ROM memory representing data for creation of a patch that is input into the data source 36. Travel of belt 18 brings the areas bearing the latent charge images into a development station 38. Development station 38 has magnetic brushes in juxtaposition to the travel path of the belt. Magnetic brush development stations are well known.

LCU 24 selectively activates the development station 38 in relation to the passage of the image areas containing latent images to selectively bring the magnetic brush into engagement with or a small spacing from the belt. The charged toner particles of the engaged magnetic brush are attracted imagewise to the latent image pattern to develop the pattern.

As is well understood in the art, conductive portions of the development station 38, such as conductive applicator cylinders, act as electrodes. The electrodes are connected to a variable supply of D.C. or A.C.+D.C. potential $V_B$ regulated by a programmable controller 40. Details regarding the development station 38 are provided as an example, but are not essential to the invention.

As is also well known, a transfer station 46 is provided for moving a receiver sheet S into engagement with the photoconductor on belt 18, in register with the image, for transferring the image to receiver S. Alternatively, the image may be transferred to an intermediate member, and then from the intermediate member to receiver S. A cleaning station 48 is downstream from transfer station 46 and removes toner from belt 18 to allow reuse of the surface for forming additional images. A belt 18, a drum photoconductor or other structure may be used for supporting an image. After transfer of the unfixed toner images to receiver sheet S, sheet S is transported to a fuser station 49 where the image is fixed.

LCU 24 provides overall control of the apparatus and its various subsystems as is well known. Programming commercially available microprocessors is a conventional skill well understood in the art. LCU 24 maintains and stores parametric values necessary for the operation of both the invention and the overall electrophotographic apparatus 10. Among these parameters is the aim value for toner concentration, which determines how much stored toner must be supplied to the mixture to maintain image quality.

The invention uses a current sensor 80 to measure the current $I_{exp}$ used by the writer at exposure station 34 to estimate the amount of toner to be used for an image. The writer interface has two output lines, 70 and 72. Line 70 carries the data for switching the LEDs in the writer on and off as well as conventional communication control signals. Line 72 carries power control signals for operating the writer power supply that supplies current to the LEDs of the writer 34. In its simplest form, a current sense signal is the voltage across a resistor in series with the writer power supply. In the form shown in detail in FIG. 2, the current sensor 80 is a combination of an offset control differential amplifier 88 and a shunt resistor 89. The shunt resistor 89 has a very low resistance on the order of 0.001 ohms. The differential amplifier has a high input impedance. It senses the voltage drop across the shunt resistor 89 and provides an output signal $I_{exp}$ representative of the exposure current. The current sensor 89 receives a control signal from the LCU 24 to zero the current sensor or optionally to provide automatic offset adjustment and null out standby current of the writer. Estimating toner takeout from $I_{exp}$ is based on the fact that the total exposure energy $E_0$ is proportional to $V_{exp}$, the writer voltage, times $I_{exp}$. For a constant voltage power supply for the writer, therefore, exposure energy $E_0$ is proportional to $I_{exp}$ alone. The exposure energy $E_0$, initial voltage $V_0$ of the photoconductor, and the intrinsic photoconductor properties determine the voltage of the exposed image used for development.

The invention uses writer current, as just described, for systems using LEDs as writing devices. For systems that write with lasers, the lasers may be switched on and off, or they may be gated by some means of interrupting the flow of light energy to the photoconductor. In systems where the lasers are switched on and off, the invention uses the writer current to the lasers. In systems where the lasers are gated, the invention uses the controlling voltages or currents to the gating components in place of the writer current, in such a way as to calculate the total energy used in the writing of the image. With any exposure means, the system can use the intensity of light transmitted through the photoconductor or reflected from the photoconductor to calculate the total energy used in writing the image.

Calibration

In the preferred embodiment, the invention calibrates toner replenishment rate as follows. A first current measurement is made using current sensor 80 when the writer is in a quiescent or "standby" state. Other measurements are made for exposure of a process control patch. Image density measurements are likewise made and the LCU 24 determines TU, the amount of toner used per unit energy of exposure or unit current used for exposure $I_{unit\text{-}exp}$. For many applications, the amount of toner used per unit of exposure is approximately constant and can be pre-determined. For extremely precise control, the toner take-out per unit of exposure can be recalculated periodically. It can also depend upon the initial photoconductor voltage, $V_0$, the state of the toning station, toner charge-to-mass ratio, and aim image density. The rate of toner use per unit of exposure, TU, as determined by LCU 24 during calibration, is stored in LCU 24 for use during normal operation. LCU 24 also stores writer quiescent current level $I_{qui}$ and writer unit current used for exposure $I_{unit\text{-}exp}$ as measured at current sensor 80. It should be noted that voltages or other signals capable of being combined arithmetically, as discussed here, may represent current levels.

Normal Operation

Figure 2:
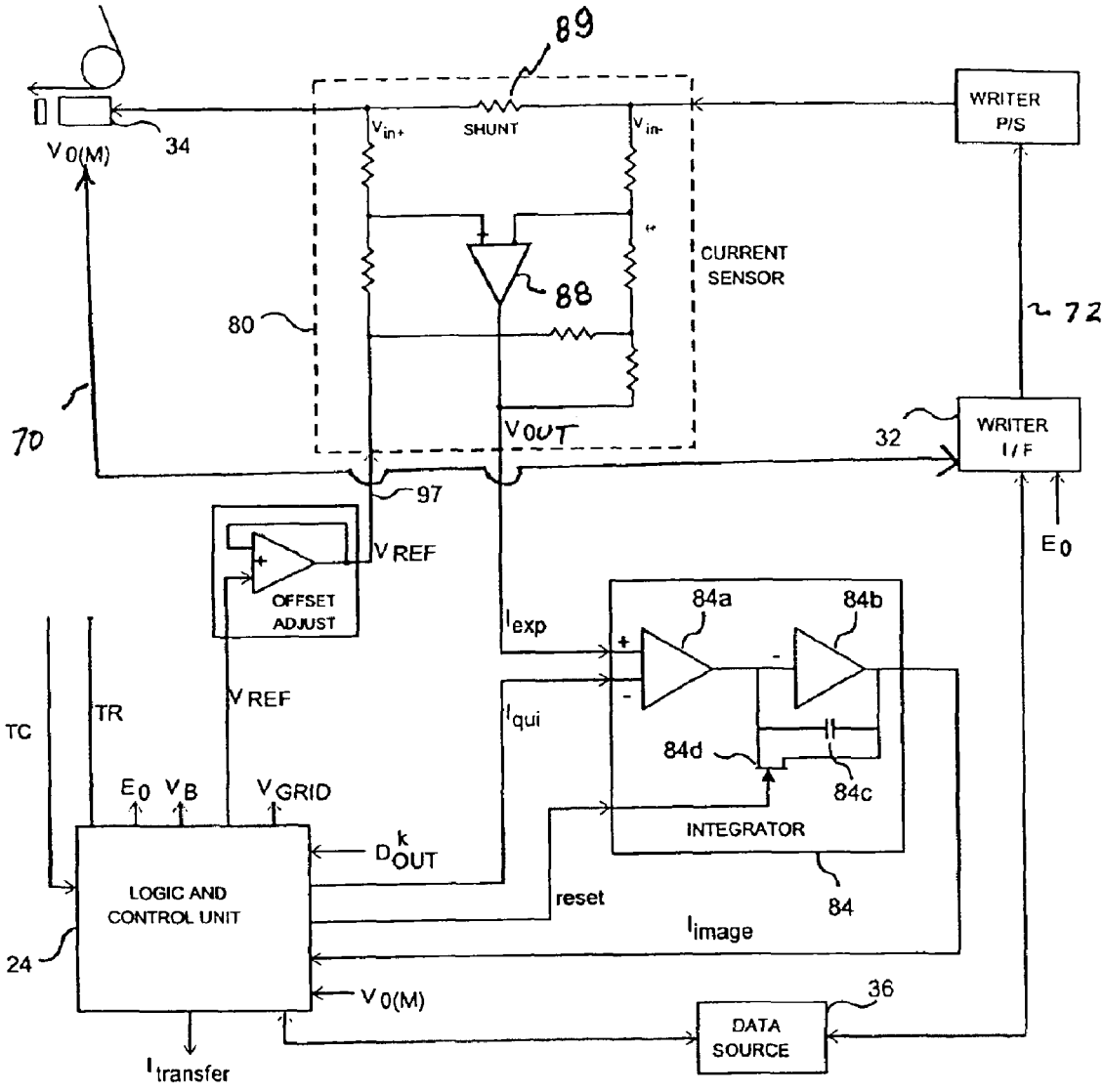
FIG. 2 shows the invention's connections between the current sensor, the integrator, and the LCU.

In normal operation, while images are being exposed onto the photoconductor, LCU 24 receives toner usage signals by monitoring the current to exposure station 34. Refer to FIG. 2, which shows a more detailed view of the connections between current sensor 80, integrator 84, and LCU 24. When writer 34 is in normal operation, integrator 84 receives current measurement signals representing $I_{exp}$ from current sensor 80 for exposure of an image, and current level signals representing $I_{qui}$ from LCU 24 for writer current during quiescence. Integrator 84 calculates the difference representing $I_{exp}-I_{qui}$ using a differential amplifier 84*a*, and integrates the difference over time using an amplifier 84*b* with a capacitor 84*c* to determine total current consumption for the entire image, $I_{image}$. Integrator 84 transmits a signal representing $I_{image}$ to LCU 24. Between images, LCU 24 sends integrator 84 a reset signal to prepare for the integration of current signals for the next image. The reset signal is applied to the integrator 84*b*, 84*c* via a zeroing switch 84*d*, which is here shown as a JFET. Zeroing switch 84*d* may also be a MOSFET or other switching device with similarly acceptable characteristics.

LCU 24 uses the calibrated TU with the measured $I_{image}$ to determine the amount of toner TI used for the image exposure. The calculation is, essentially, $TI=TU\times(I_{image}/I_{unit\text{-}exp})$. Based on the calculated value of TI, the supplied value of toner concentration TC, and the aim value for toner concentration, LCU 24 sends to the replenishment subsystem a toner replenishment signal TR, which triggers the replenisher to add toner from the toner bottle to the toning station so that toner concentration is maintained well within useful limits.

LCU 24 may initiate a calibration cycle between images in order to adjust and store any previously calibrated values. The methods of scheduling and carrying out such calibrations are numerous and well known in the art.

The use of an analog integration process to determine the amount of toner takeout is fast, simple, and inexpensive. By contrast, prior-art methods relying on pixel counts require an investment in raster image processing software and hardware for the system, to count the pixels and calculate the energy required for each pixel. The invention eliminates this investment and complexity. An image already stored on a computer as a bitmap would require pixel-by-pixel processing using these prior-art methods, but measurement of the writer current eliminates such a process entirely. Such an image can be printed directly.

In the preferred embodiment, the invention's method of toner replenishment is supplemented by algorithms based on estimates of toner concentration TC in the toning station that are activated when toner concentration deviates far from the aim value. A magnetic toner monitor in the development station usually determines toner concentration. Methods of determining toner concentration are numerous and well known in the art, as are the algorithms for their use in toner replenishment. The present invention considers their use as supplementary to the invention's own method as described above, and necessary only in exceptional cases. Such cases may occur when the toning station's concentration of toner deviates sharply from the invention's basic projections as described here.

This means of toner replenishment can be used with process control schemes for maintaining image density that, for example, adjust $V_0$ and exposure. The aim value of toner concentration can change depending on conditions such as toner charge or developer life, photoconductor or image voltage, and exposure. In particular, if initial photoconductor voltage or exposure intensities are near maximum values, the aim toner concentration can be increased.

The invention's method is a means of determining toner replenishment rates based on estimates of toner takeout for the actual images that are printed. Similar methods for estimating toner takeout per image include the following.

One alternative method is to estimate the actual exposure and the corresponding toner usage by measuring the intensity of light transmitted or reflected from the photoconductor adjacent to the exposure device, using a light pipe or large area photodetector. By translating the light intensity level into a voltage or current signal, and by calibrating light intensity versus toner consumption, the light intensity over time is integrated and applied using the invention's method as described above.

A second alternative method is to measure the density of the toned image with a densitometer having the width of the image. This densitometer replaces the existing densitometer, or else is situated adjacent to the post-development erase lamp(s). Again, by translating the measured image density into a voltage or current signal, and by calibrating density versus toner consumption, the image density over time is integrated and applied using the invention's method as described above.

A third alternative method is to measure the density of the toned image on the receiver. This differs from the second alternative method only in the location of measurement.

Any of these means of estimating toner takeout per image can also be used for replenishment algorithms that supplement or replace replenishment methods based on measurements of average toner concentration.

Overall, the invention uses a simple analog integration technique to produce a fast, accurate, and useful measure of toner consumption. This technique obviates the need for digital calculation and its supporting hardware, and may be used to replace other more-complex replenishment processes. The invention's simplicity and effectiveness make it less costly to build, install, and maintain. This advantage consequently renders the electrophotographic systems in which the invention operates more robust and less costly, which translates into a commercial advantage for the makers of such products.

CONCLUSION, RAMIFICATIONS, AND SCOPE OF INVENTION

From the above descriptions, figures and narratives, the invention's advantages in providing accurate and inexpensive toner replenishment should be clear.

Although the description, operation and illustrative material above contain many specificities, these specificities should not be construed as limiting the scope of the invention but as merely providing illustrations and examples of some of the preferred embodiments of this invention.

Thus the scope of the invention should be determined by the appended claims and their legal equivalents, rather than by the examples given above.

For example, the invention may be applied to an electrographic printer or so-called direct printer. Those printers use ion beams or toner streams to directly apply toner to a copy sheet. As mentioned above, when the applied voltage of the writer is held constant, the applied current is representative of power. However, the invention can be used with variable voltage and variable currents. A signal representative of power can be derived by sampling the variable voltage and variable current, storing the sampled values, multiplying the stored values together to derive a power value and then integrating the power values over the measured time period to derive an energy signal.

The invention also contemplates variables in the electrographic or electrophotographic machine. It is possible that a user will vary the TU constant in accordance with $V_O$, toning station state, image aim (target) density or toner charge-to-mass ratio. Those skilled in the art will recognize that corresponding changes must be made in the energy consumption estimate of toner consumption.

What is claimed is:

1. An electrographic process for measuring toner consumption and replenishing consumed toner comprising the steps of moving an imaging member along a path for receiving and developing a latent image, writing a latent image on the imaging member, measuring the energy consumed during the writing step, applying toner from a toner supply to the latent image to develop the latent image into a toner image, and replenishing the toner in the toner supply in an amount proportional to the energy consumed by the writing step.

2. The method of claim 1 wherein the step of measuring the energy consumed during the writing step further comprises measuring voltage applied to an LED writer, measuring current applied to the LED writer, and generating a power signal proportional to the product of the applied voltage and applied current;

averaging the power signal over the latent image to determine the energy consumed to write the latent image.

3. The method of claim 1 wherein the step of measuring the energy consumed during the writing step further comprises holding an LED writer at a fixed potential, measuring current to the writer, and averaging the current over the latent image to determine the energy consumed to write the latent image.

4. The method of claim 1 wherein the step of measuring the energy consumed during the writing step further comprises measuring intensity of light reflected by or transmitted through a toner image to generate the signal representative of energy used to write the latent image.

5. The method of claim 1 wherein the step of measuring the energy consumed during the writing step further comprises measuring power applied to a laser writer and current applied to a laser shutter to generate a signal representative of the energy consumed to write the latent image.

6. An electrographic process for measuring toner consumption and replenishing consumed toner comprising the steps of moving an imaging member along a path for receiving and developing a latent image, measuring quiescent power consumption prior to the step of writing a latent image, writing a latent image on the imaging member, measuring power consumption during the step of writing a latent image, averaging the net measured power consumption over the entire image, applying toner from a toner supply to the latent image to develop the latent image into a toner image, and replenishing the toner in the toner supply in an amount proportional to the net measured power consumption.

7. The method of claim 6 wherein the step of measuring the energy consumed during a writing step comprises the steps of measuring the amount of toner transferred to a calibration patch of a known area and known image density, generating a toner unit signal representative of the amount of toner transferred to the calibration patch per unit, and storing the toner unit signal, generating a toner use signal proportional to the product of the toner unit signal and the size of the latent image.

8. The method of claim 6 comprising the further steps of forming a latent image on a photoconductor, developing the image with toner, and transferring the toned image to the imaging member.

9. The method of claim 6 comprising the further step of forming directly on the imaging member the latent image or toned image.

10. An electrographic apparatus that measures toner consumption and replenishes consumed toner comprising:

means for moving an imaging member along a path for receiving and developing a latent image, means for writing a latent image on the imaging member, means for measuring the energy consumed to write the latent image, means for applying toner from a toner supply to the latent image to develop the latent image into a toner image, and means for replenishing the toner in the toner supply in an amount proportional to the energy consumed by writing the latent image.

11. The apparatus of claim 10 further comprising:

means for measuring quiescent power consumption prior to writing a latent image, means for measuring power consumed while writing a latent image, and means for averaging the measured net power consumed to write the entire image to provide a signal representative of the energy used to write the latent image and the toner consumed to develop the latent image.

12. The apparatus of claim 11 further comprising a photoconductor for holding the latent image, developing the latent image with toner, and means for transferring the toned image to the imaging member.

13. The apparatus of claim 11 wherein the latent toner image is formed directly on the imaging member.

14. The apparatus of claim 11 wherein the means for measuring the energy consumed during the writing step further comprises means for measuring voltage applied to an LED writer, means for measuring current applied to the LED writer, and means for generating a power signal proportional to the product of the applied voltage and applied current;

means for averaging the power signal over the latent image to determine the energy consumed to write the latent image.

15. The apparatus of claim 10 wherein the means for measuring the energy consumed during the writing step further comprises means for holding an LED writer at a fixed potential, means for measuring current to the writer, and means for averaging the net current over the latent image to determine the energy consumed to write the latent image.

16. The apparatus of claim 10 wherein the means for measuring the energy consumed during the writing step further comprises means for measuring intensity of light reflected by or transmitted through a toner image to generate the signal representative of energy used to write the latent image.

17. The apparatus of claim 10 wherein the means for measuring the energy consumed to write the latent image further comprises means for measuring power applied to a laser writer and current applied to a laser shutter to generate the signal representative of the energy consumed to write the latent image.

18. The apparatus of claim 10 wherein the means for measuring the energy consumed to write the latent image further comprises means for measuring power applied to a laser writer and current applied to a laser shutter to generate the signal representative of the energy consumed to develop the latent image.

19. The apparatus of claim 11 further comprising means for measuring the amount of toner transferred to a calibration patch of a known area and known image density, means for generating a toner unit signal representative of the amount of toner transferred to the calibration patch per unit, and means for storing the toner unit signal, means for generating a toner use signal proportional to the product of the toner unit signal and the size of the latent image.

20. An electrophotographic reproduction process for measuring toner consumption and replenishing consumed toner for purposes of calibration, comprising the steps of moving a photoconductor along a path for receiving and developing a latent image, charging the photoconductor to a desired charge level, exposing with an exposure system the photoconductor to a calibration image of known characteristics to selectively discharge the photoconductor and form a latent image thereupon, applying toner to the latent image to develop the latent image into a calibration patch, measuring quiescent current of the exposure system before exposure, measuring the exposure current during imaging, averaging the measured currents over the length of the exposure, measuring the amount of toner transferred to the calibration patch, generating a proportion value from the ratio of the amount of toner transferred to the calibration patch to the difference between the two measured currents, and storing the proportion value for use during normal operation of the exposure system.

21. The process of claim 20 wherein the measured currents are proportional to voltages on the photoconductor and the steps of measuring the currents comprise measuring the voltages on the photoconductor and averaging the measured voltages to generate a proportion value.

22. The process of claim 20 wherein the measured currents are proportional to light transmitted through or reflected by the photoconductor and the steps of measuring the currents comprise measuring the intensity of light transmitted through or reflected by the photoconductor before and after exposure and averaging the measured intensities to generate a proportion value.

23. The process of claim 20 wherein the measured currents are proportional to the density of the toned image on the photoconductor and the steps of measuring the currents comprise measuring density of the photoconductor image before and after toning and averaging the measured densities to generate a proportion value.

24. The process of claim 20 wherein the measured currents are proportional to light transmitted through or reflected by the photoconductor and the steps of measuring the currents comprise measuring the intensity of light transmitted through or reflected by the photoconductor before and after exposure and averaging the measured intensities to generate a proportion value.

25. The process of claim 20 wherein the step of exposing the photoconductor to a calibration image comprises exposing the photoconductor to light from an array of light-emitting diodes sequenced and placed so as to reproduce the calibration image on the photoconductor.

26. The process of claim 20 wherein the step of exposing the photoconductor to a calibration image comprises exposing the photoconductor to light from an array of laser outputs sequenced and placed so as to reproduce the calibration image on the photoconductor.

27. The process of claim 20 where the proportional value for replenishment is periodically adjusted based on the value of the photoconductor voltage, aim image density, or state of the toner and toning station.

28. An electrophotographic reproduction process for measuring toner consumption and replenishing consumed toner during normal operation comprising the steps of moving a photoconductor along a path for receiving and developing a latent image, charging the photoconductor to a desired charge level, exposing with an exposure system the photoconductor to an image to selectively discharge the photoconductor and form a latent image thereupon, applying toner to the latent image to develop the latent image into a toner image, transferring the developed toner image to a receiver sheet, measuring quiescent current of the exposure system before exposure, measuring the exposure current during imaging, averaging the measured currents over the length of the exposure, generating a toner replenishment signal proportional to the difference between the two measured currents, and replenishing toner in an amount proportional to the toner replenishment signal.

29. The process of claim 28 wherein the measured currents are proportional to voltages on the photoconductor and the steps of measuring the currents comprise measuring the voltages on the photoconductor and averaging the measured voltages to generate a toner replenishment signal.

30. The process of claim 28 wherein the measured currents are proportional to light transmitted through or reflected by the photoconductor and the steps of measuring the currents comprise measuring the intensity of light transmitted through or reflected by the photoconductor before and after exposure and averaging the measured intensities to generate a toner replenishment signal.

31. The process of claim 28 wherein the measured currents are proportional to the density of the toned image on the photoconductor and the steps of measuring the currents comprise measuring density of the photoconductor image before and after toning and averaging the measured densities to generate a toner replenishment signal.

32. The process of claim 28 wherein the measured currents are proportional to the density of the toned image on a receiver sheet and the steps of measuring the currents comprise measuring density of a receiver sheet before and after toning and averaging the measured densities to generate a toner replenishment signal.

33. The process of claim 28 wherein the step of exposing the photoconductor to an image comprises exposing the photoconductor to light from an array of light-emitting diodes sequenced and placed so as to reproduce the calibration image on the photoconductor.

34. The process of claim 28 wherein the step of exposing the photoconductor to an image comprises exposing the photoconductor to light from an array of laser outputs sequenced and placed so as to reproduce the calibration image on the photoconductor.

35. An electrophotographic reproduction apparatus with a photoconductor traveling along a path for receiving and developing a latent image, the photoconductor traversing a path that passes a plurality of processing stations including a charging station for charging the photoconductor to a desired charge level, an exposure station for exposing the photoconductor to a document to selectively discharge the photoconductor and form a latent image of the document, a toning station including a rotating magnetic core for applying toner to the photoconductor to develop the latent image, a transfer station for transferring the developed latent image to a receiver sheet, and further comprising:

means for measuring a first quantity representative of quiescent current of the photoconductor before exposure;

means for measuring a second quantity representative of exposure current of the photoconductor during imaging;

means for averaging the measured quantities over the length of the exposure;

means for generating a toner replenishment signal proportional to the difference between the two averaged quantity signals; and means for replenishing toner in an amount proportional to the toner replenishment signal.

36. The apparatus of claim 35 wherein the currents are proportional to voltages on the photoconductor, the photoconductor is normally charged to a known voltage and the means for measuring the exposure current comprises an electrometer disposed at or after the exposure station for measuring the voltage on the photoconductor after exposure.

37. The apparatus of claim 35 wherein the currents are proportional to light transmitted through or reflected by the photoconductor and the means for measuring the currents comprise a photometer or photodetector for measuring intensity of light transmitted through or reflected by the photoconductor before and after exposure.

38. The apparatus of claim 35 wherein the currents are proportional to density of the toned image on the photoconductor and the means for measuring the currents comprise one or more densitometers disposed proximate the photoconductor for measuring density of the photoconductor image before and after toning.

39. The apparatus of claim 35 wherein the currents are proportional to density of the toned image on the photoconductor and the means for measuring the currents comprise one or more densitometers disposed proximate the receiver sheet for measuring density of the receiver sheet before and after toning.

40. An electrophotographic reproduction apparatus with a photoconductor traveling along a path for receiving and developing a latent image, the photoconductor traversing a path that passes a plurality of processing stations including a charging station for charging the photoconductor to a desired charge level, an exposure station for exposing the photoconductor to a document to selectively discharge the photoconductor and form a latent image of the document, a toning station including a rotating magnetic core for applying toner to the photoconductor to develop the latent image, a transfer station for transferring the developed latent image to a receiver sheet, and further comprising:

a current sensor for measuring a first quantity representative of quiescent current of the photoconductor before exposure, and measuring a second quantity representative of exposure current of the photoconductor during imaging;

an integrator circuit for averaging the measured quantities over the length of the exposure;

a logic and control unit for generating a toner replenishment signal proportional to the difference between the two averaged quantity signals; and a toner replenishment subsystem for replenishing toner in an amount proportional to the toner replenishment signal.

41. The apparatus of claim 40 wherein the currents are proportional to voltages on the photoconductor, the photoconductor is normally charged to a known voltage and the current sensor comprises an electrometer disposed at or after the exposure station for measuring the voltage on the photoconductor after exposure.

42. The apparatus of claim 40 wherein the currents are proportional to light transmitted through or reflected by the photoconductor and the current sensor comprises a photometer or photodetector for measuring intensity of light transmitted through or reflected by the photoconductor before and after exposure.

43. The apparatus of claim 40 wherein the currents are proportional to density of the toned image on the photoconductor and the current sensor comprises one or more densitometers disposed proximate the photoconductor for measuring density of the photoconductor image before and after toning.

44. The apparatus of claim 40 wherein the currents are proportional to density of the toned image on the photoconductor and the current sensor comprises one or more densitometers disposed proximate the receiver sheet for measuring density of the receiver sheet before and after toning.

* * * * *